United States Patent [19]

Faubert

[11] 4,355,879

[45] Oct. 26, 1982

[54] PHOTOGRAPHIC DEVELOPING TANK

[75] Inventor: Guy Faubert, Creteil, France

[73] Assignee: Diaralux, Creteil, France

[21] Appl. No.: 237,663

[22] Filed: Feb. 24, 1981

[30] Foreign Application Priority Data

Aug. 14, 1980 [FR] France ..... 80 18004

[51] Int. Cl.[3] ..... G03D 3/00; G03D 13/04

[52] U.S. Cl. ..... 354/329; 354/333; 354/337

[58] Field of Search ..... 354/312, 329, 330, 333, 354/335, 337

[56] References Cited

U.S. PATENT DOCUMENTS 3,705,544 12/1972 Ratowsky ..... 354/329
3,735,961 5/1973 Taylor ..... 354/330
3,792,651 2/1974 Banks ..... 354/330
4,169,671 10/1979 Culler ..... 354/312

FOREIGN PATENT DOCUMENTS 2735447 2/1978 Fed. Rep. of Germany ..... 354/329

*Primary Examiner*—L. T. Hix
*Assistant Examiner*—Alan Mathews
*Attorney, Agent, or Firm*—Wolf, Greenfield & Sacks

[57] ABSTRACT

This invention concerns a photographic developing tank in which at least one of the end panels is removable and in which the cylindrical container includes at this end at least one slot or lug for the reception and the angular positioning of a sleeve of which the diameter corresponds to that of the container, this sleeve engaging between the container and the end panel.

2 Claims, 2 Drawing Figures

PHOTOGRAPHIC DEVELOPING TANK

The invention concerns a photographic developing tank. Photographic developing tanks are already known which consist of a cylindrical container closed at its ends by panels, one of the end panels being provided with an orifice which permits a liquid product to be charged into the container before being agitated onto the photographic paper substantially disposed inside the tank with a view to making the photographic negative appear on this paper.

The internal wall of the container is provided with longitudinal ribs in order to ensure the correct positioning of the photographic paper when the tank containing the active liquid is rotationally driven.

However, these developing tanks are very rarely of a length which corresponds to one of the dimensions of rectangular developing paper, so that the small dimension of the paper is smaller than the length of the tank. There should in any event be used a quantity of active liquid which is sufficient, taking account of the length of the tank, to coat the width of the paper rolled against the inside wall of the tank.

On the other hand, if the smallest dimension of the paper is larger than the length of the tank, the latter becomes unusable and it is advisable to obtain another tank having larger dimensions.

The particular object of the present invention is to remedy these defects and to this end concerns a photographic developing tank comprising a cylindrical container of circular cross-section closed by end panels, one of these panels being provided with an orifice for the entry of a developing product for acting on the sensitized paper disposed inside the container, this container further having on its internal face longitudinal ribs for positioning the sensitized paper, the tank being characterized in that at least one of the end panels is detachable and in that the cylindrical container includes at this extremity at least one lug or slot for the reception and the angular positioning of a sleeve of which the diameter corresponds to that of the container, this sleeve engaging between the container and the end panel.

According to another characteristic of this invention, the sleeve includes longitudinal ribs on its internal wall and at least one lug or slot at at least one of its ends, the ribs and the lugs or slots of the sleeve corresponding in position and dimension to those of the container.

The invention is shown by way of non-limiting example in the attached drawings, in which.

Figure 1:
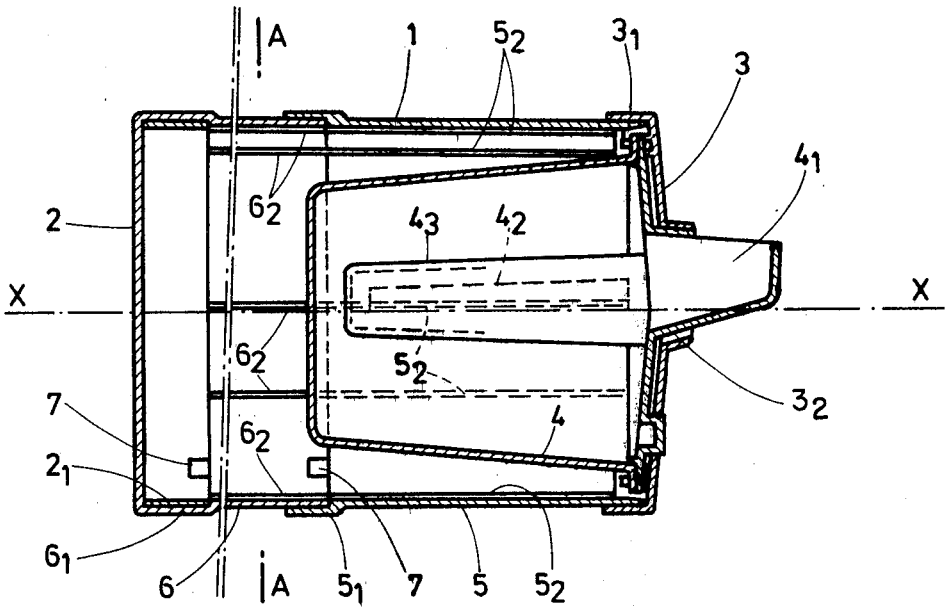
FIG. 1 is a longitudinal section of one embodiment of a developing tank according to the invention.
Figure 2:
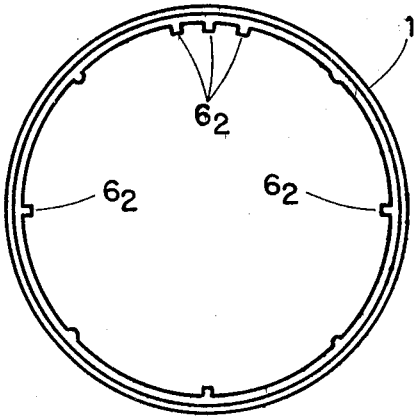
FIG. 2 is a section along A—A in FIG. 1.

The present invention consequently has the object of providing a photographic developing tank, which can be adapted to the dimensions of the developing paper used, and which therefore permits photographic development by using a just sufficient quantity of the liquid active product.

This developing tank shown in the attached drawings comprises a cylindrical container of circular cross-section 1 having an axis X—X and which is closed at one of its ends by a base panel 2 and at its other end by a cover panel 3.

The cover panel 3 includes an orifice $3_2$ from the interior of which projects the pouring lip $4_1$ of a container 4 which is provided with two longitudinal diametrically-opposed slits $4_2$.

Partitions $4_3$ are located opposite to these two slits $4_2$ and in the interior of the container.

The base panel 2 and the cover panel 3 are engaged, the first in the interior and the second on the exterior of the box 1, by means of annular collars, $2_1$, $3_1$ respectively.

The base panel 2 is removably engaged on the end of the container 1 and this container is itself formed in several parts of which 1, 5, are the main part of the container and of which the others, 6, are cylindrical sleeves of the same diameter which form an extension of the part 5.

The part 5 and the sleeve 6 each includes at one of their extremities an annular inter-engaging rim $5_1$, $6_1$ respectively, with a view to nesting removably either with the annular rim of the base panel 2, or the opposite extremity of the sleeve 6.

It can be seen that, by this construction, it is possible to modify the length of the container 1 of the tank by fitting to the end of the part 5 one or several sleeves 6 so as to adapt the length of this box to the dimensions of the developing container used.

On the internal wall of the container 1 composed of the part 5 and a sleeve or sleeves 6, are provided longitudinal ribs $5_2$, $6_2$ respectively which are to serve as stops for the ends of the development paper so as to locate it in a curved position against the internal wall of the container.

The part 5 of the container, the sleeves 6 as well as the base panel 2 further include, at their nesting end, at least one corresponding lug or slot 7, these various lugs and slots being positioned with respect to the ribs $5_2$ and $6_2$ so as to be located in the extension the one of the other at the time of nesting.

To put this tank into operation, it is preferred to choose the number of sleeves 6 which are necessary considering the dimensions of the paper used, to nest these sleeves one inside the other on the end of the part 5 so that each lug lodges in a corresponding slot 7, then to place between the appropriate stops $5_2$ and $6_2$ the one extending the other.

The base panel 2 having been nested in the free end of the last sleeve 6 and the tank 1 having been placed in a horizontal position, the active liquid product is then poured in through the lip $4_1$ and then the tank is set in rotation in such a way that, during the course of this rotation, the liquid product runs through the slits $4_2$ on the interior of the container 1 to act on the sentisized paper.

I claim:

1. A photographic developing tank comprising a cylindrical container of circular section (1) closed by end panels (2,3), one of said panels being provided with an orifice ($3_2$) for the introduction of a developing product for acting on sensitized paper disposed inside the tank, and one of said panels being movable from a first end of said cylindrical container, said container further having on its internal surface longitudinal ribs for the positioning of said sensitive paper, said tank further comprising a cylindrical sleeve (6) the internal diameter of which corresponds to that of the container and the internal surface of which is provided with longitudinal ribs ($6_2$) corresponding in position and dimension to those of the container, said sleeve being engageable between said first end of the container and said removeable end panel, alignment means being provided at said first end of said container and at the adjacent end of said sleeve for aligning said sleeve so that the ribs of the sleeve are aligned with the ribs of the container.

2. The tank of claim 1, wherein said alignment means comprise at least one slot and at least one lug for mating with said slot, one being provided on said first end of said container while the other is provided at the adjacent end of said sleeve.

* * * * *